US011808544B1

(12) United States Patent
Chu et al.

(10) Patent No.: US 11,808,544 B1
(45) Date of Patent: Nov. 7, 2023

(54) ANTI-DRY FIRE TRIGGER DEVICE

(71) Applicant: Man Kung Enterprise Co., Ltd., Taichung (TW)

(72) Inventors: Fu-Hui Chu, Taichung (TW); Ching-Chi Hung, Taichung (TW)

(73) Assignee: Man Kung Enterprise Co., Ltd., Taichung (TW)

( * ) Notice: Subject to any disclaimer, the term of this patent is extended or adjusted under 35 U.S.C. 154(b) by 0 days.

(21) Appl. No.: 17/898,583

(22) Filed: Aug. 30, 2022

(51) Int. Cl.
*F41B 5/12* (2006.01)
*F41B 5/14* (2006.01)

(52) U.S. Cl.
CPC ..... *F41B 5/1469* (2013.01); *F41B 5/12* (2013.01)

(58) Field of Classification Search
CPC ..... F41B 5/12
See application file for complete search history.

(56) References Cited

U.S. PATENT DOCUMENTS

| | | | | |
|---|---|---|---|---|
| 6,736,123 | B1 * | 5/2004 | Summers | F41B 5/1469 124/40 |
| 7,770,567 | B1 * | 8/2010 | Yehle | F41A 17/46 124/40 |
| 9,435,605 | B2 * | 9/2016 | McPherson | F41B 5/12 |
| 9,523,549 | B1 * | 12/2016 | Hughes | F41B 5/1469 |
| 9,689,638 | B1 * | 6/2017 | Yehle | F41B 5/1469 |
| 9,909,832 | B2 * | 3/2018 | Darlington | F41B 5/12 |
| 10,012,468 | B1 * | 7/2018 | Kempf | F21V 33/008 |
| 11,015,892 | B1 * | 5/2021 | Jessup | F41A 17/20 |
| 2020/0025505 | A1 * | 1/2020 | Rowzie, Jr. | F41B 5/12 |

* cited by examiner

*Primary Examiner* — John A Ricci

(57) ABSTRACT

An anti-dry fire trigger device contains: a trigger seat, an arrow retainer, a string hook, a connection trigger, a safety switch, and an engagement element. The trigger seat includes a channel, a slidable actuation element, and an accommodation groove having two defining orifices. The arrow retainer includes a press portion, a limitation portion, and a first rotatable connection portion. The string hook includes a hooking portion, an abutting portion, and a second rotatable coupling portion. The connection trigger rotatably includes a fastening portion and a driving portion. The safety switch slidably includes two slidable posts configured to limit the safety switch on an opening position and a closing position. The engagement element slidably is connected with the safety switch and includes a defined portion.

8 Claims, 11 Drawing Sheets

ANTI-DRY FIRE TRIGGER DEVICE

BACKGROUND OF THE INVENTION

Field of the Invention

The present invention relates to a trigger device, and more particularly to an anti-dry fire trigger device of a crossbow.

Description of the Prior Art

A conventional crossbow contains a body and a limb. A rear end of the body is provided with a stock, and a front end of the stock is provided with a trigger device. The trigger device includes a trigger seat, a safety switch, a string hook, and a trigger. The trigger device further includes an aiming sight element. The limb is curved, fixed adjacent to a front end of the body, and crossed with the body. A bowstring is defined between two ends of the limb. When in use, the bowstring is pulled back to tighten and to engage with the trigger device, and an arrow is placed on the body and abuts against the bowstring, then a user aims at the target by using the aiming sight, pulls the trigger of the trigger device so that the bowstring removes from the trigger device, and the arrow is pushed by the bowstring to shoot.

Although the conventional trigger device of the crossbow is applied to trigger the arrow, the arrow will be shot after triggering the trigger carelessly by pushing a safety element. Furthermore, when the bowstring is hooked on the string hook and the arrow is not placed in the trigger device after being pulled, the bowstring removes from the string hook to shoot idly in case the user triggers the trigger carelessly, and a pulling force cannot be transformed into a shooting speed of the arrow and spreads to the crossbow to damage the limb and the bowstring, thus reducing a service life of the crossbow and injuring the user and related people near to the user.

Referring to FIGS. 10 and 11, a conventional anti-dry fire trigger device has been developed to overcome above-mentioned problem. The conventional anti-dry fire trigger device contains a trigger seat 91, a safety element 92, and a retention seat 93. The trigger seat 91 includes a channel 911 defined in a middle section of a front end thereof, an arrow retainer 912 arranged above the channel 911, a receiving groove 913 and an arcuate orifice 914, wherein the receiving groove 913 is in communication with the channel 911, the arcuate orifice 914 communicates with the receiving groove 913. The trigger seat 91 includes a trigger 915 and a string hook 916 which are rotatably connected adjacent to the channel 911. The safety element 92 is received in the channel 912, and the retention seat 93 is accommodated in the receiving groove 913, wherein the retention seat 93 includes a rotatable connection portion 931 formed on a first end thereof, a defining portion 932 formed on a second end thereof opposite to the first end of the retention seat 93, a protrusion 933 proximate to the defining portion 932, and a slidable post 934 connected on a side of the protrusion 933. The retention seat 93 is rotatably connected with the trigger seat 91 by way of the rotatable connection portion 931, a column 935 defined between the rotatable connection portion 931 and the defining portion 932 of the retention seat 93, a spring 936 defined between the column 935 and the receiving groove 913 so that the retention seat 93 is pushed by the spring 936 to abut against the channel 911, and the slidable post 934 is slidably received in the arcuate orifice 914.

Even though the retention seat 93 of the conventional anti-dry fire trigger device is configured to avoid dry firing when the arrow is not placed in the triggering position and the user triggers the trigger carelessly to obtain using safety, the protrusion 933 of the retention seat 93 has to be arranged adjacent to the defining portion 932, the slidable post 934 is connected with the protrusion 933, and the trigger seat 91 has to defined the arcuate orifice 914 for receiving the slidable post 934 slidably to cause complicate structure, troublesome assembly, and high fabrication cost.

The present invention has arisen to mitigate and/or obviate the afore-described disadvantages.

SUMMARY OF THE INVENTION

The primary object of the present invention is to provide an anti-dry fire trigger device which is configured to avoid dry firing of a crossbow and a damage of an limb and an arrow string of the crossbow to protect a user and related staffs near the user, thus enhancing using safety, obtaining simply structure and assembly, and reducing fabrication cost.

To provide above-mentioned objects, an anti-dry fire trigger device provided by the present invention contains: a trigger seat, an arrow retainer, a string hook, a connection trigger, a safety switch, and an engagement element.

The trigger seat includes a channel extending backward from a middle section of a front end of the trigger seat, and an accommodation groove defined on a rear side of the channel in the trigger seat. The accommodation groove has two defining orifices formed on at least one of two sides of the accommodation groove, and the trigger seat further includes a slidable actuation element received and sliding upward and downward in a rear side of the accommodation groove.

The arrow retainer is rotatably connected adjacent to a front end of the trigger seat, and the arrow retainer includes a press portion formed on a first end of the arrow retainer, a limitation portion and a first rotatable connection portion formed on a second end of the arrow retainer, such that the arrow retainer is rotatably connected with the trigger seat by using the first rotatable coupling portion, a first spring is defined between the arrow retainer and the trigger seat so that the arrow retainer is pushed by the first spring to abut against the channel and to limit the limitation portion.

The string hook is rotatably connected in the trigger seat located on a rear side of the arrow retainer. The string hook includes a hooking portion formed on a first end thereof, an abutting portion formed on a second end of the string hook, a second rotatable coupling portion defined between the hooking portion and the abutting portion, such that the string hook is rotatably connected with the trigger seat by using the second rotatable connection portion, and a second spring is defined between the string hook and the trigger seat so that the string hook is pushed by the second spring and the hooking portion of the string hook removes from the channel in a normal state.

The connection trigger is rotatably connected proximate to a bottom of the trigger seat, the connection trigger includes a fastening portion formed on a first end of the connection trigger, and the connection trigger includes a driving portion formed on a second end of the connection trigger, such that the driving portion of the connection trigger engages with the actuation element. A third rotatable coupling portion is defined between the fastening portion and the driving portion, such that the connection trigger is rotatably connected with the trigger seat by using the third rotatable coupling portion, and the connection trigger is not triggered in the normal state.

The safety switch is slidably received in the accommodation groove, and the safety switch includes two slidable posts extending from at least one side of two sides of the safety switch into the two defining orifices of the trigger seat so that the safety switch is limited on an opening position and a closing position to switch.

The engagement element is slidably received in the trigger seat, a first end of the engagement element is connected with the safety switch, and the engagement element includes a defined portion extending from a second end thereof so that the engagement element is switched to move forward and rearward with the safety switch. When the defining portion of the engagement element is stopped by the press portion of the arrow retainer, the safety switch is limited to not slide to the opening position, thus obtaining anti-dry fire trigger.

DETAILED DESCRIPTION OF THE PREFERRED EMBODIMENTS

Figure 1:
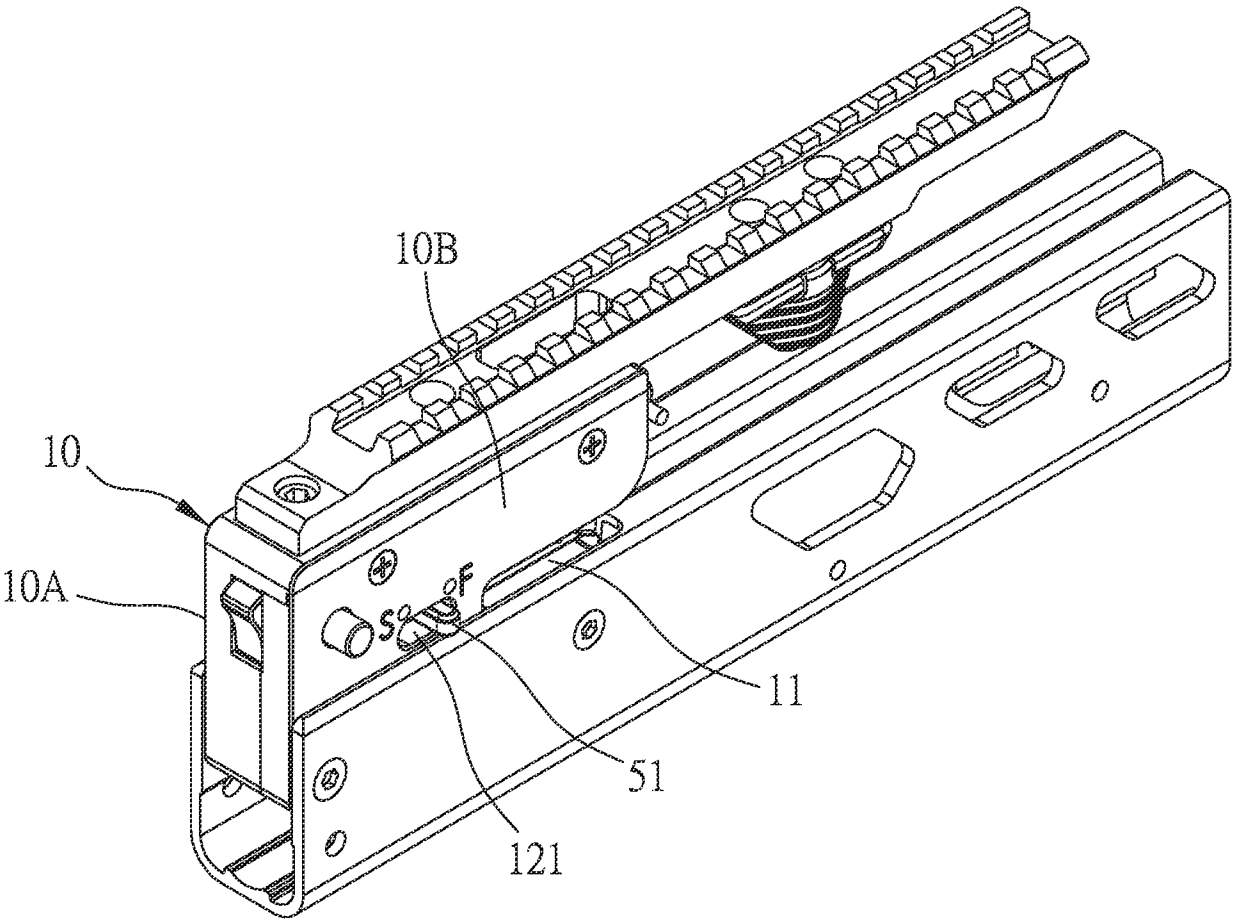
FIG. 1 is a perspective view showing the assembly of an anti-dry fire trigger device according to a preferred embodiment of the present invention.
Figure 2:
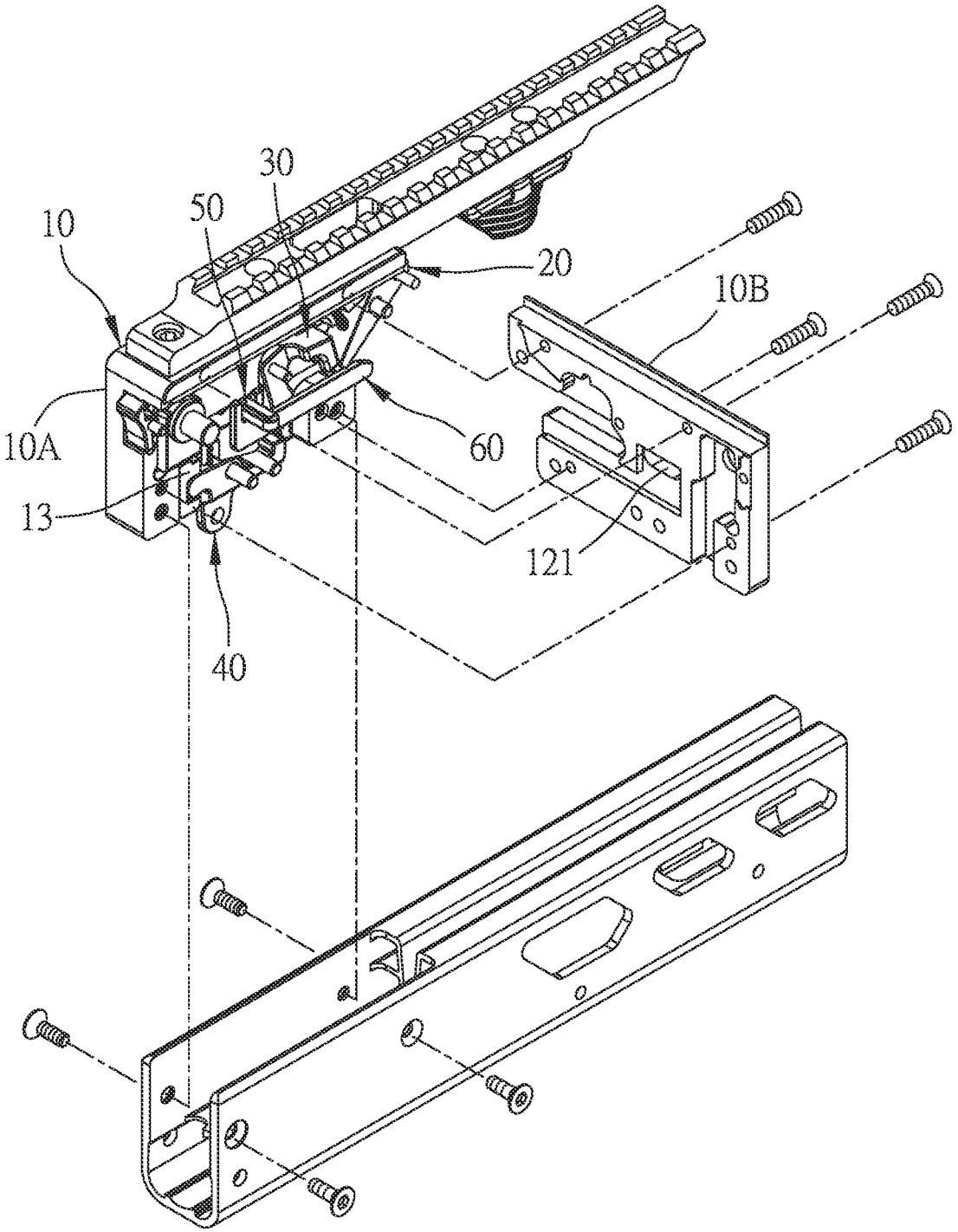
FIG. 2 is a perspective view showing the exploded components of the anti-dry fire trigger device according to the preferred embodiment of the present invention.
Figure 3:
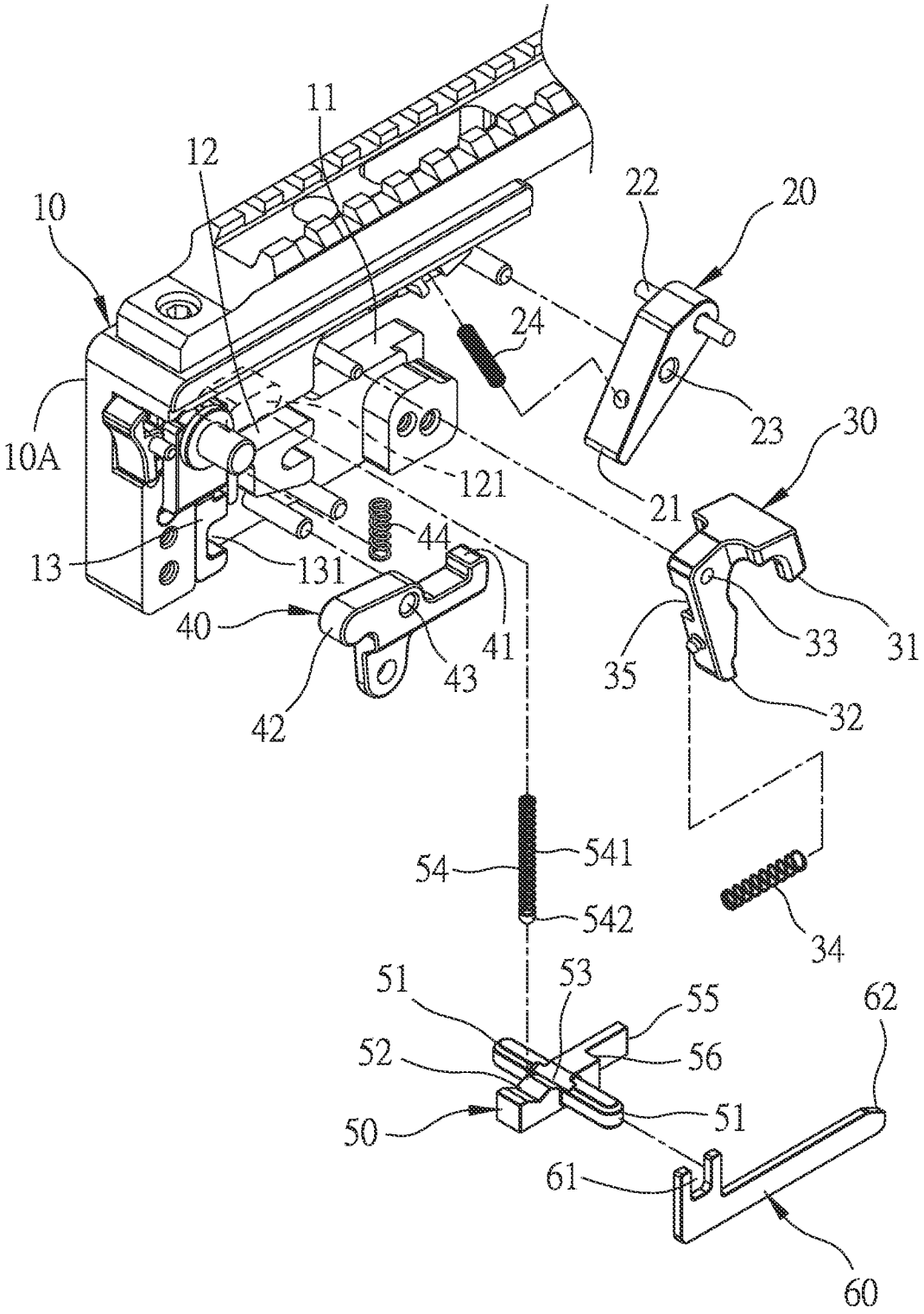
FIG. 3 is another perspective view showing the exploded components of the anti-dry fire trigger device according to the preferred embodiment of the present invention.
Figure 4:
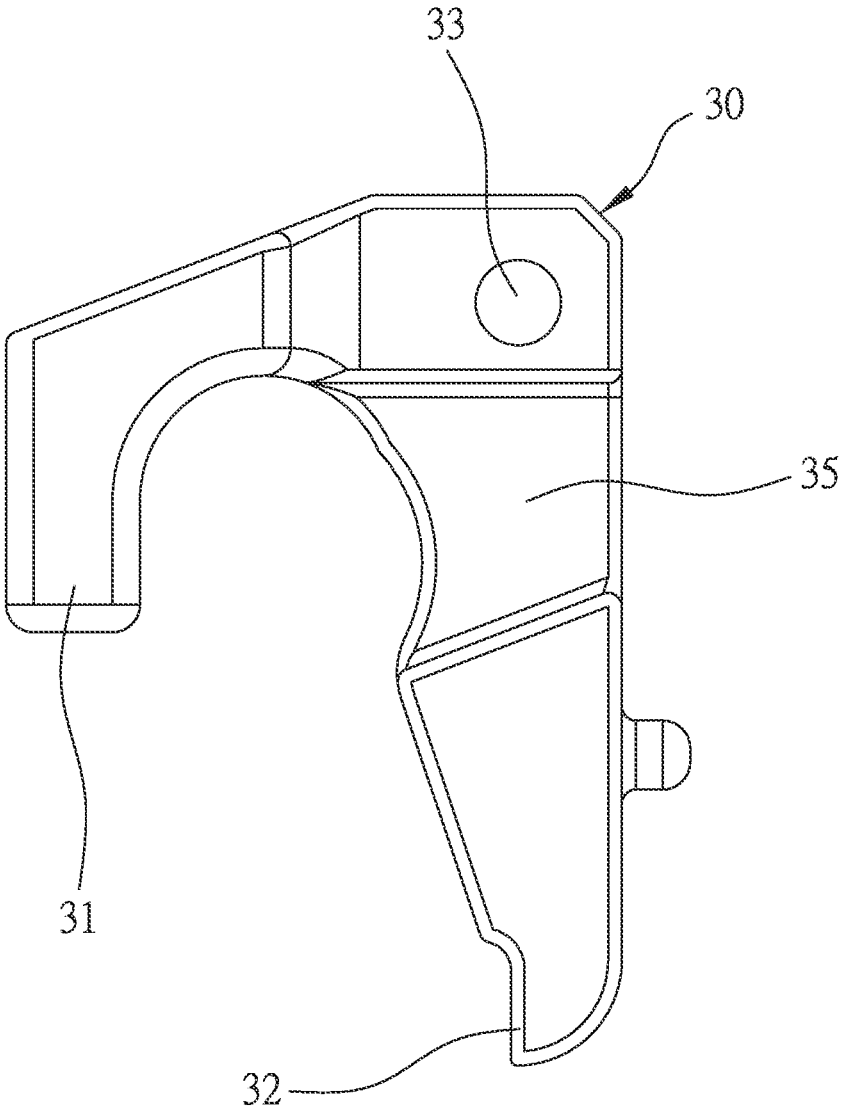
FIG. 4 is a side plan view showing the assembly of a string hook of the anti-dry fire trigger device according to the preferred embodiment of the present invention.
Figure 5:
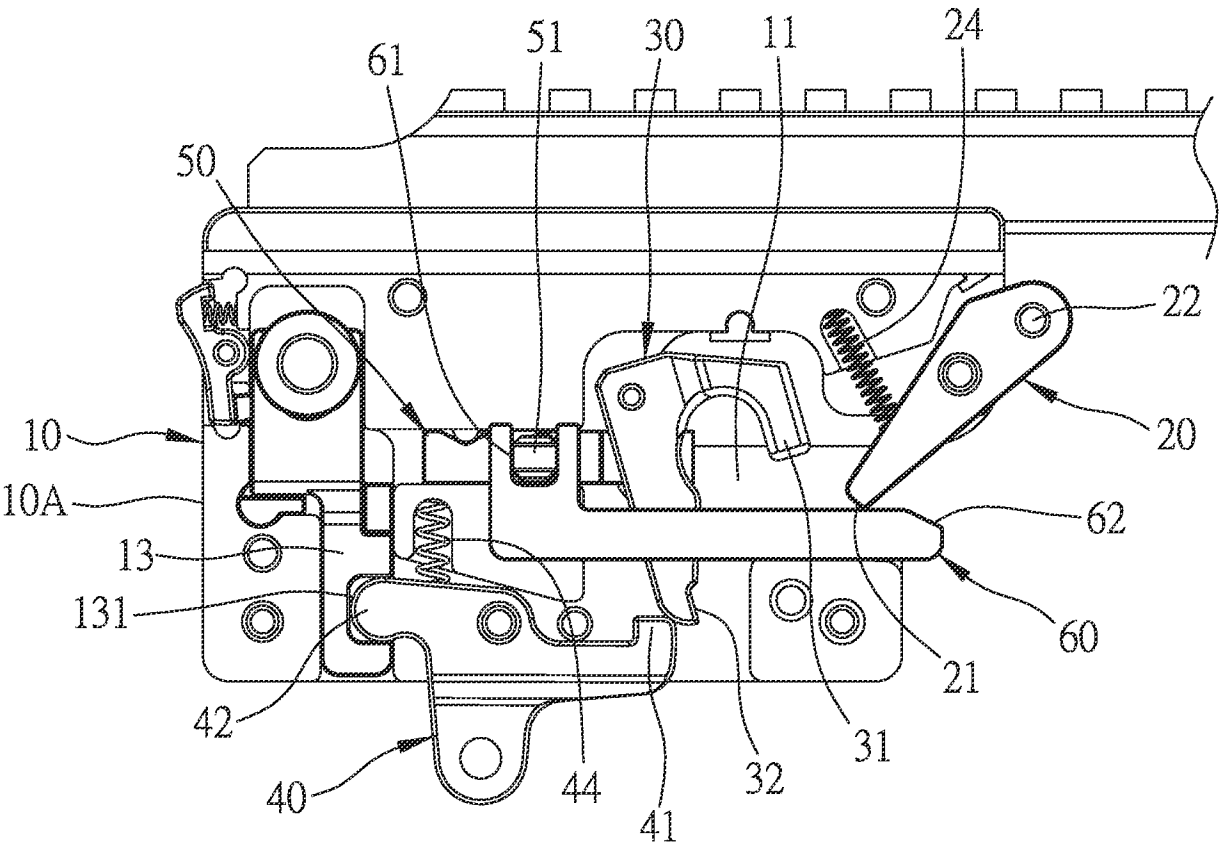
FIG. 5 is a side plan view showing the assembly of the anti-dry fire trigger device according to the preferred embodiment of the present invention.

The present invention will be clearer from the following description when viewed together with the accompanying drawings, which show, for purpose of illustrations only, a preferred embodiment in accordance with the present invention.

With reference to FIGS. 1 to 5, an anti-dry fire trigger device according to a preferred embodiment of the present invention comprises: a trigger seat 10, an arrow retainer 20, a string hook 30, a connection trigger 40, a safety switch 50, and an engagement element 60.

The trigger seat 10 includes a first lid 10A, a second lid 10B covered with the first lid 10A, a channel 11 extending backward from a middle section of a front end of the trigger seat 10, and an accommodation groove 12 defined on a rear side of the channel 11 in the trigger seat 10, wherein the accommodation groove 12 has two defining orifices 121 formed on two sides of the accommodation groove 12, and the trigger seat 10 further includes a slidable actuation element 13 received and sliding upward and downward in a rear side of the accommodation groove 12, wherein the slidable actuation element 13 has a trench 131 defined therein.

The arrow retainer 20 is rotatably connected adjacent to a front end of the trigger seat 10, and the arrow retainer 20 includes a press portion 21 formed on a first end thereof, a limitation portion 22 formed on a second end thereof, and a first rotatable connection portion 23 defined between the press portion 21 and the limitation portion 22 (wherein the first rotatable connection portion 23 is a hole in this embodiment). The arrow retainer 20 is rotatably connected with the trigger seat 10 by using the first rotatable coupling portion 23 so that the arrow retainer 20 is rotated along the first rotatable coupling portion 23, wherein a first spring 24 is defined between the arrow retainer 20 and the trigger seat 10, and the arrow retainer 20 is pushed by the first spring 24 to abut against the channel 11 and to limit the limitation portion 22.

The string hook 30 is rotatably connected in the trigger seat 10 and is located on a rear side of the arrow retainer 20, wherein the string hook 30 includes a hooking portion 31 formed on a first end thereof, an abutting portion 32 formed on a second end of the string hook 30, a second rotatable coupling portion 33 defined between the hooking portion 31 and the abutting portion 32 (wherein the second rotatable connection portion is a hole in this embodiment), such that the string hook 30 is rotatably connected with the trigger seat 10 by using the second rotatable connection portion 33. A second spring 34 is defined between the string hook 30 and the trigger seat 10 so that the string hook 30 is pushed by the second spring 34 and the hooking portion 31 removes from the channel 11 in a normal state. The abutting portion 32 extends below the channel 11, and the string hook 30 includes an orifice 35 defined on a rear side thereof and increasing a width of a diameter of the orifice 35 forward.

The connection trigger 40 is rotatably connected proximate to a bottom of the trigger seat 10, the connection trigger 40 includes a fastening portion 41 formed on a first end thereof, and the connection trigger 40 includes a driving portion 42 formed on a second end thereof, such that the driving portion 42 of the connection trigger 40 engages with and drives the trench 131 of the actuation element 13. A third rotatable coupling portion 43 is defined between the fastening portion 41 and the driving portion 42 (wherein the third rotatable coupling portion 43 is a hole in this embodiment), such that the connection trigger 40 is rotatably connected with the trigger seat 10 by using the third rotatable coupling portion 43. A third spring 44 is defined between the connection trigger 40 and the trigger seat 10 so that the connection trigger 40 is pushed by the third spring 44, wherein the connection trigger is not triggered in the normal state, and when the connection trigger 40 is triggered, the connection trigger 40 actuates the actuation element 13 to move upward.

Figure 6:
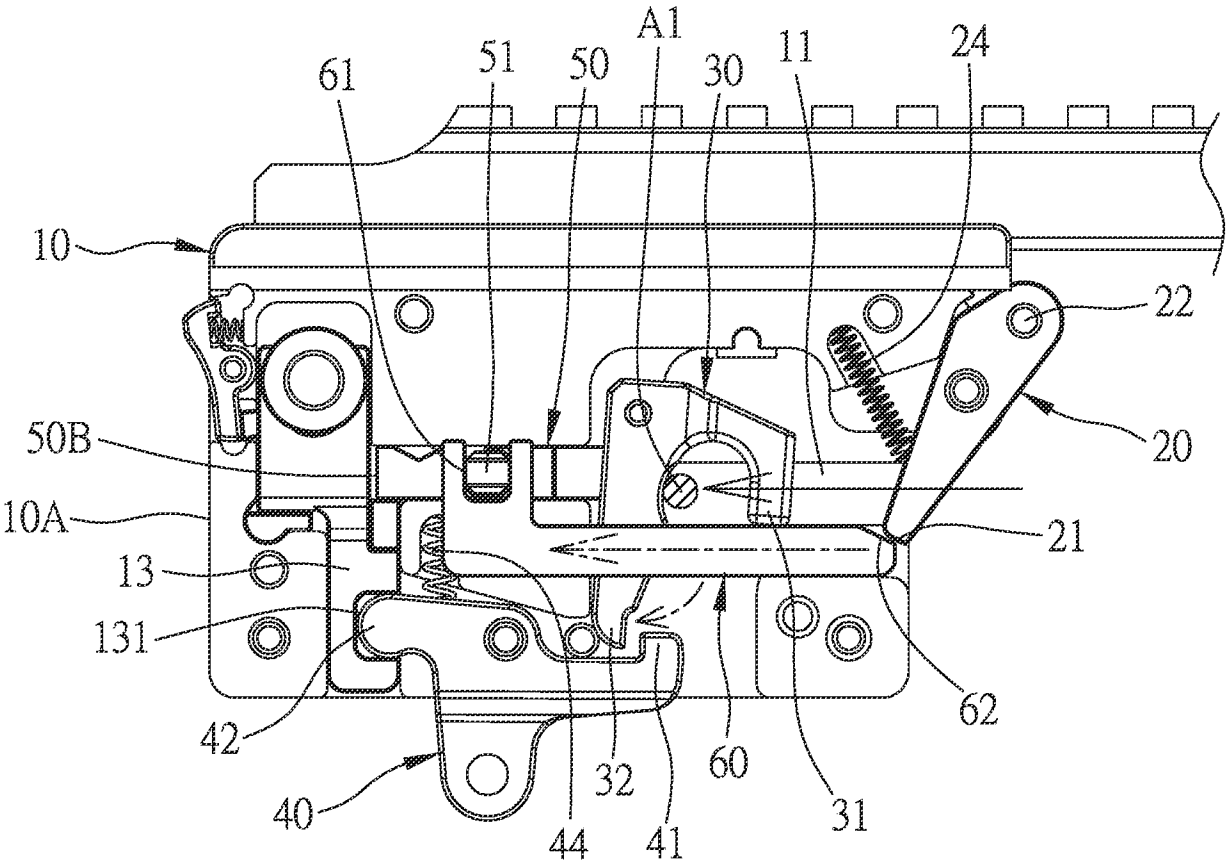
FIG. 6 is a side plan view showing the operation of the anti-dry fire trigger device according to the preferred embodiment of the present invention.
Figure 7:
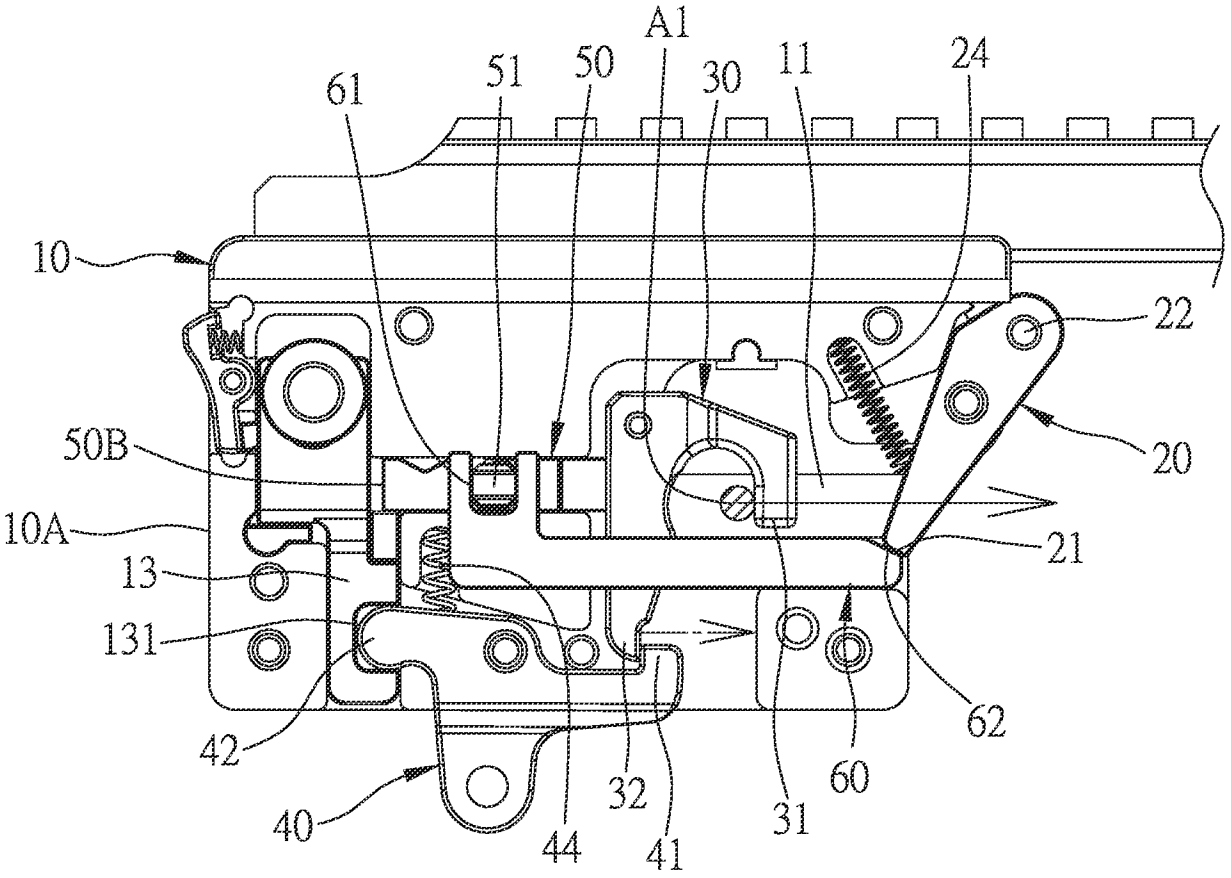
FIG. 7 is another side plan view showing the operation of the anti-dry fire trigger device according to the preferred embodiment of the present invention.
Figure 8:
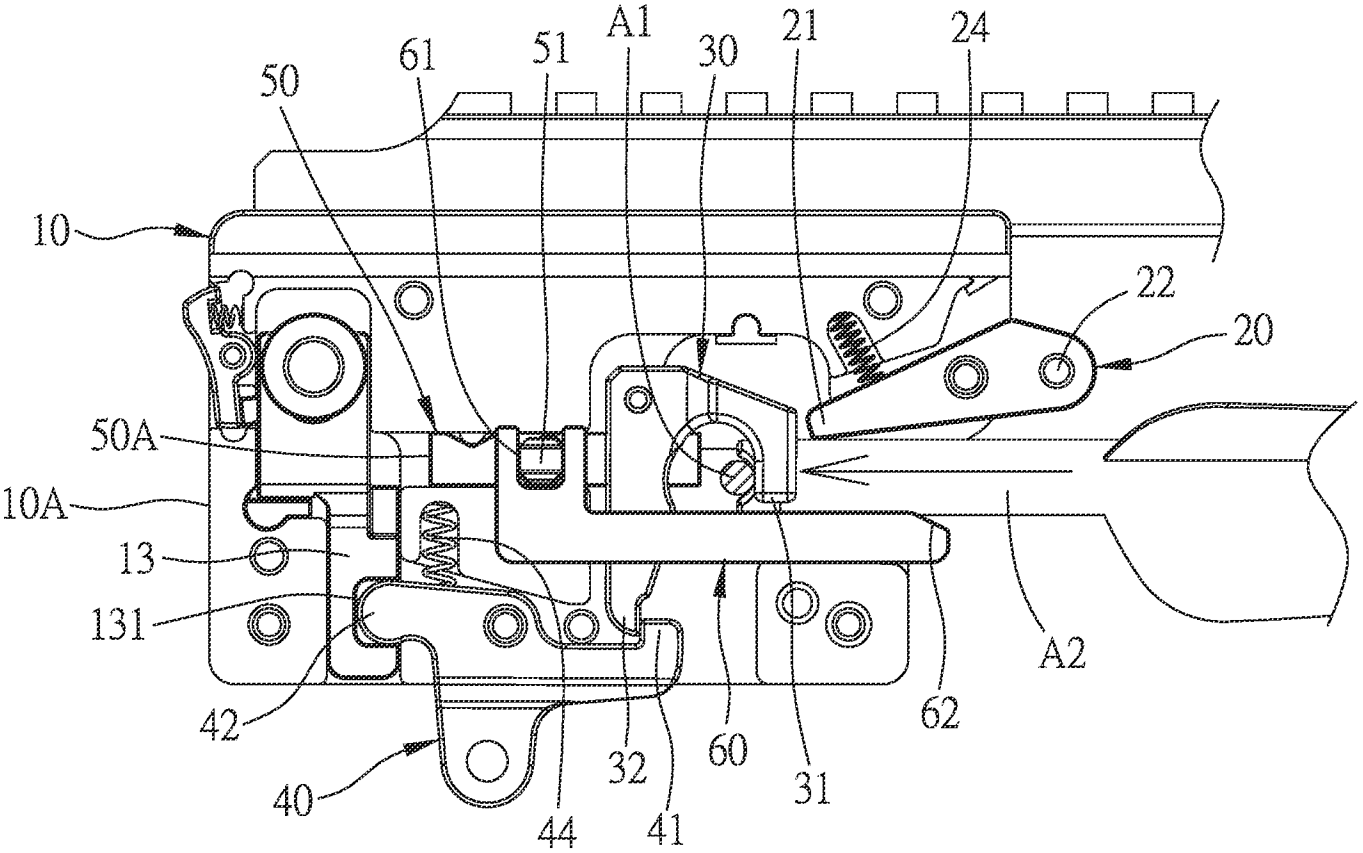
FIG. 8 is also another side plan view showing the operation of the anti-dry fire trigger device according to the preferred embodiment of the present invention.
Figure 9:
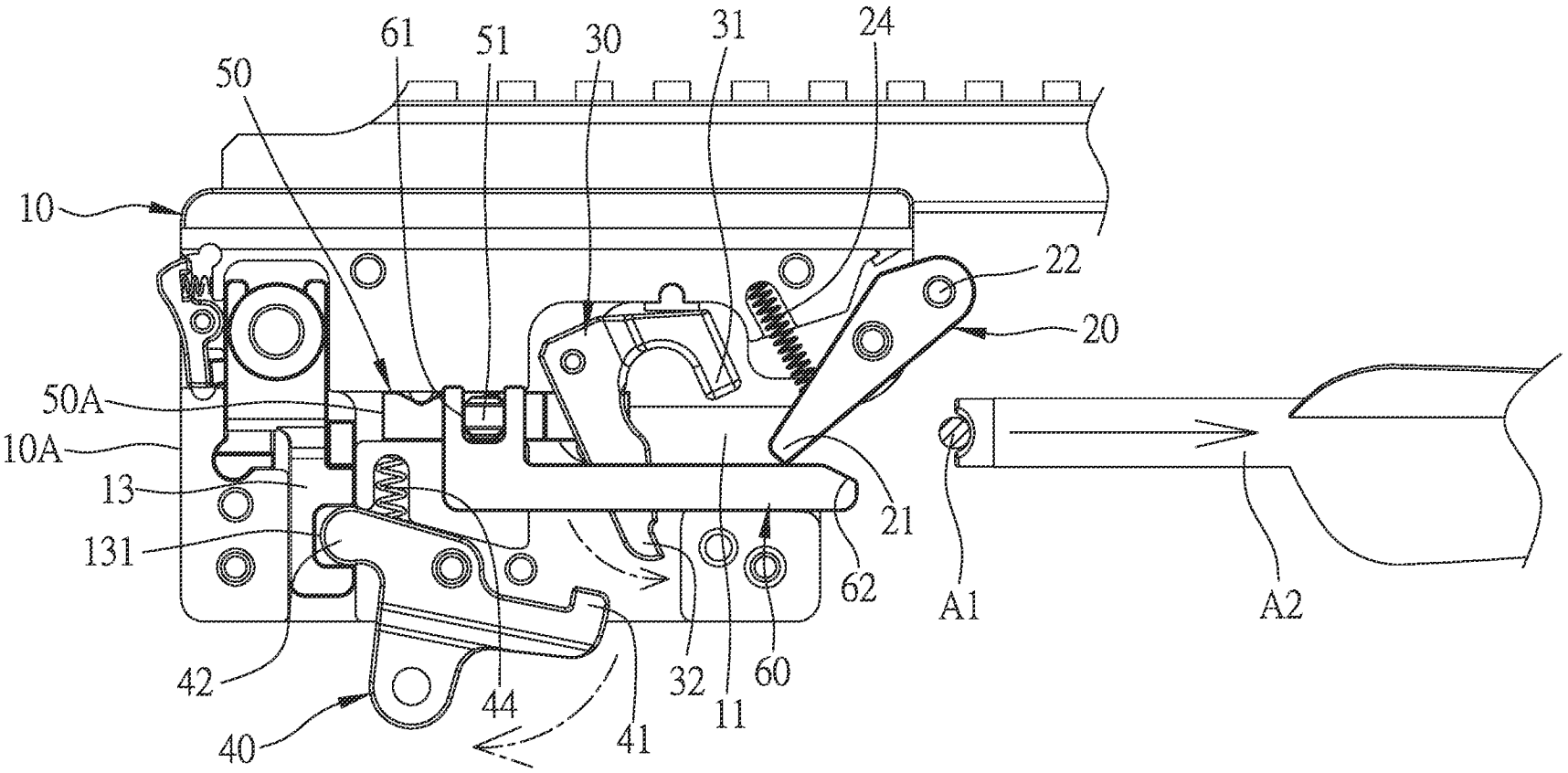
FIG. 9 is still another side plan view showing the operation of the anti-dry fire trigger device according to the preferred embodiment of the present invention.
Figure 10:
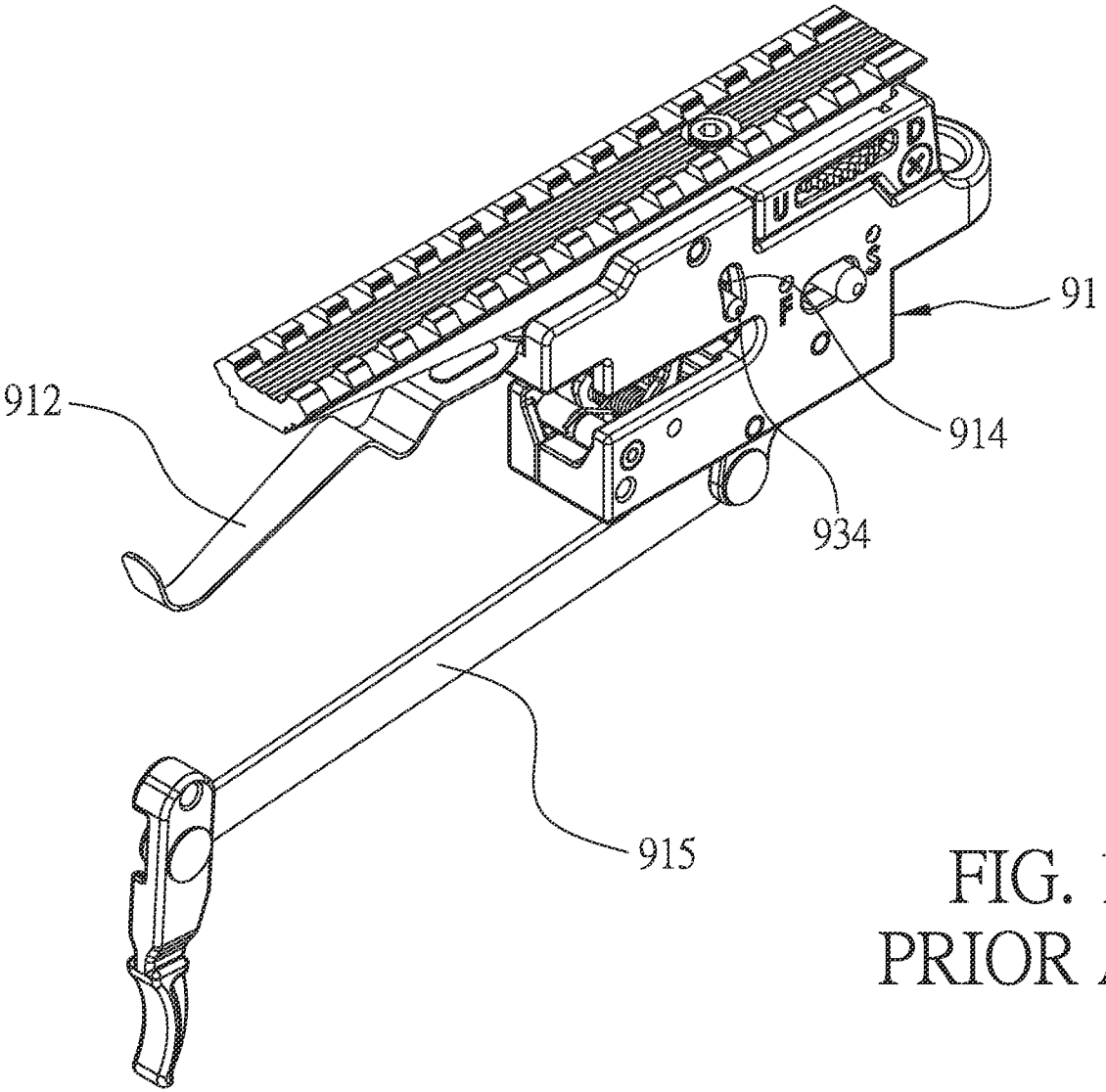
FIG. 10 PRIOR ART
FIG. 10 is a perspective view of a conventional anti-dry fire trigger device.
Figure 11:
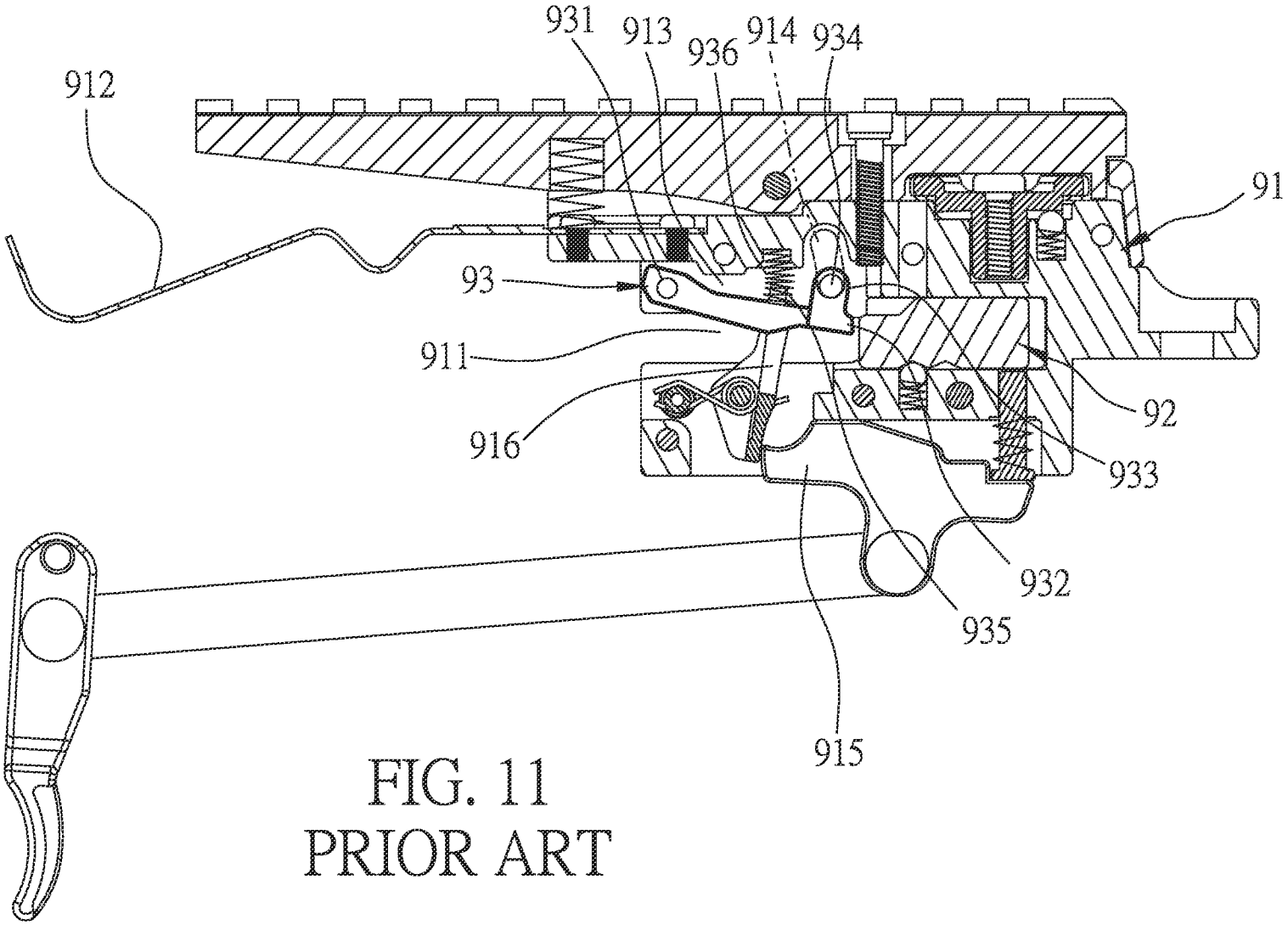
FIG. 11 PRIOR ART
FIG. 11 is a cross sectional view of the conventional anti-dry fire trigger device.

The safety switch 50 is slidably received in the accommodation groove 12, and the safety switch 50 includes two slidable posts 51 extending from two sides of the safety switch 50 into the two defining orifices 121 of the trigger seat 10 so that the safety switch 50 is limited on an opening position 50A (as shown in FIGS. 8 and 9) and a closing position 50B (as shown in FIGS. 6 and 7) to switch, wherein the safety switch 50 includes a first locating slot 52 and a second locating slot 53 which are configured to abut against a positioning assembly 54, and the positioning assembly 54 has a fourth spring 541 and a steel ball 542 connected with a distal end of the fourth spring 541, wherein a position of the first locating slot 52 abutting against the positioning assembly 54 is the opening position 50A of the safety switch 50, a position of the second locating slot 53 abutting against the positioning assembly 54 is the closing position 50B of the safety switch 50, when the safety switch 50 is located on the closing position 50B, the slidable actuation element 13 is stopped by the safety switch 50 to not slide upward so that the connection trigger 40 is not pressed to trigger. Furthermore, the safety switch 50 includes an insertion 55 and a positioning portion 56 extending from an end thereof which faces to the string hook 30, and the insertion 55 is received in the diameter increasing orifice 35 of the string hook 30.

The engagement element 60 is slidably received in the trigger seat 10, the engagement element 60 includes a joining portion 61 extending from a first end thereof, and the engagement element 60 includes a defined portion 62 extending from a second end thereof, wherein the joining portion 61 is a notch and is engaged with the two slidable posts 51 of the safety switch 50 so that the engagement element 60 moves forward and backward with the safety switch 50.

Referring to FIGS. 6 and 7, when shooting an arrow A2, the string A1 is pulled rearward to hook on the hooking portion 31 of the string hook 30, and the abutting portion 32 of the string hook 30 is reengaged by the fastening portion 41 of the connection trigger 40. In the meantime, the string A1 does not nock with the arrow A2, and the press portion 21 of the arrow retainer 20 stops the defined portion 62 of the engagement element 60, so that the engagement element 60 limits the safety switch 50 not to switch to the opening position 50A from the closing position 50B, thus avoiding dry firing.

When placing the arrow A2 in the channel 11, as illustrated in FIG. 8, the arrow A2 is located on a shooting position, the arrow retainer 20 is pushed upward by the arrow A2, and the press portion 21 of the arrow retainer 20 does not stop the defined portion 62 of the engagement element 60 so that the safety switch 50 is switch to the opening position 50A from the closing position 50B, and the slidable actuation element 13 is not stopped by the safety switch 50 to slide upward. When desiring to trigger the connection trigger 40, as shown in FIG. 9, the connection trigger 40 actuates the actuation element 13 to move upward, the fastening portion 41 of the connection trigger 40 removes from the abutting portion 32 of the string hook 30, and the string hook 30 is pushed by the second spring 34 to remove the hooking portion 31 of the string hook 30 from the channel 11, hence the string A1 detaches from the hooking portion 31 of the string hook 30, and the arrow A2 is pushed by the string A1 to shoot.

Accordingly, the anti-dry fire trigger device of the present invention has advantages as follows:

the anti-dry fire trigger device is configured to avoid dry firing of the crossbow and a damage of a limb and an arrow string of the crossbow to protect a user and related staffs near the user, thus enhancing using safety, obtaining simply structure and assembly, and reducing fabrication cost.

While various embodiments in accordance with the present invention have been shown and described, it is clear to those skilled in the art that further embodiments may be made without departing from the scope of the present invention.

What is claimed is:

1. An anti-dry fire trigger device comprising:

a trigger seat including a channel extending backward from a middle section of a front end of the trigger seat, and an accommodation groove defined on a rear side of the channel in the trigger seat, wherein the accommodation groove has two defining orifices formed on at least one of two sides of the accommodation groove, and the trigger seat further includes a slidable actuation element received and sliding upward and downward in a rear side of the accommodation groove;

an arrow retainer rotatably connected adjacent to a front end of the trigger seat, and the arrow retainer including a press portion formed on a first end of the arrow retainer, a limitation portion and a first rotatable connection portion formed on a second end of the arrow retainer, such that the arrow retainer is rotatably connected with the trigger seat by using the first rotatable coupling portion, a first spring is defined between the arrow retainer and the trigger seat so that the arrow retainer is pushed by the first spring to abut against the channel and to limit the limitation portion;

a string hook rotatably connected in the trigger seat located on a rear side of the arrow retainer, wherein the string hook includes a hooking portion formed on a first end thereof, an abutting portion formed on a second end of the string hook, a second rotatable coupling portion defined between the hooking portion and the abutting portion, such that the string hook is rotatably connected with the trigger seat by using the second rotatable connection portion, and a second spring is defined between the string hook and the trigger seat so that the string hook is pushed by the second spring and the hooking portion of the string hook removes from the channel in a normal state;

a connection trigger rotatably connected proximate to a bottom of the trigger seat, the connection trigger including a fastening portion formed on a first end of the connection trigger, and the connection trigger including a driving portion formed on a second end of the connection trigger, such that the driving portion of the connection trigger engages with the actuation element, wherein a third rotatable coupling portion is defined between the fastening portion and the driving portion, such that the connection trigger is rotatably connected with the trigger seat by using the third rotatable coupling portion, and the connection trigger is not triggered in the normal state;

a safety switch slidably received in the accommodation groove, and the safety switch including two slidable posts extending from at least one side of two sides of the safety switch into the two defining orifices of the trigger seat so that the safety switch is limited on an opening position and a closing position to switch; and an engagement element slidably received in the trigger seat, a first end of the engagement element connected with the safety switch, and the engagement element includes a defined portion extending from a second end thereof so that the engagement element is switched to move forward and rearward with the safety switch; wherein when the defining portion of the engagement element is stopped by the press portion of the arrow retainer, the safety switch is limited to not slide to the opening position, thus obtaining anti-dry fire trigger.

2. The anti-dry fire trigger device as claimed in claim 1, wherein the trigger seat includes a first lid and a second lid covered with the first lid.

3. The anti-dry fire trigger device as claimed in claim 1, wherein the slidable actuation element has a trench defined therein, and the connection trigger is engaged with the trench by using the driving portion.

4. The anti-dry fire trigger device as claimed in claim 1, wherein a third spring is defined between the connection trigger and the trigger seat so that the connection trigger is pushed by the third spring, wherein the connection trigger is not triggered in the normal state.

5. The anti-dry fire trigger device as claimed in claim 1, wherein the string hook includes an orifice defined on a rear side thereof and increasing a width of a diameter of the orifice forward, the safety switch includes an insertion and a positioning portion extending from an end thereof which faces to the string hook, and the insertion is received in the orifice of the string hook.

6. The anti-dry fire trigger device as claimed in claim 1, wherein the safety switch includes a first locating slot and a second locating slot which are configured to abut against a positioning assembly, and the positioning assembly has a fourth spring and a steel ball connected with a distal end of the fourth spring, wherein a position of the first locating slot abutting against the positioning assembly is the opening position of the safety switch, a position of the second locating slot abutting against the positioning assembly is the closing position of the safety switch.

7. The anti-dry fire trigger device as claimed in claim 1, wherein when the safety switch is located on the closing position, the slidable actuation element is stopped by the safety switch to not slide upward so that the connection trigger is not pressed to trigger.

8. The anti-dry fire trigger device as claimed in claim 1, wherein the engagement element includes a joining portion extending from a first end thereof, and the joining portion is a notch, wherein the joining portion is engaged with the two slidable posts of the safety switch.

* * * * *